US008734186B2

(12) United States Patent
Panko et al.

(10) Patent No.: US 8,734,186 B2
(45) Date of Patent: May 27, 2014

(54) CABLE ASSEMBLY WITH CIRCUIT-INTERRUPTER-LEAD RECEPTACLES

(75) Inventors: James A. Panko, Wonder Lake, IL (US); Howard S. Schwartz, Long Grove, IL (US); Christopher M. Davis, Ingleside, IL (US)

(73) Assignee: Snap-on Incorporated, Kenosha, WI (US)

( * ) Notice: Subject to any disclaimer, the term of this patent is extended or adjusted under 35 U.S.C. 154(b) by 142 days.

(21) Appl. No.: 13/205,318

(22) Filed: Aug. 8, 2011

(65) Prior Publication Data

US 2012/0045927 A1 Feb. 23, 2012

Related U.S. Application Data

(60) Provisional application No. 61/374,805, filed on Aug. 18, 2010.

(51) Int. Cl.
*H01R 13/68* (2011.01)

(52) U.S. Cl.
USPC ..... 439/620.26

(58) Field of Classification Search
USPC ..... 439/188, 487–491, 620.26–620.31
See application file for complete search history.

(56) References Cited

U.S. PATENT DOCUMENTS 4,834,664 A * 5/1989 Lin ..... 439/145
5,207,594 A * 5/1993 Olson ..... 439/490
5,345,210 A * 9/1994 Swensen et al. ..... 337/163
5,816,850 A * 10/1998 Yamada et al. ..... 439/507
6,592,406 B2 * 7/2003 Liu ..... 439/620.31
7,611,376 B2 * 11/2009 Daily et al. ..... 439/419
8,328,581 B2 * 12/2012 de Chazal ..... 439/620.28
8,342,885 B2 * 1/2013 Jetton ..... 439/620.26
8,425,256 B2 * 4/2013 Aoki et al. ..... 439/620.26
2002/0106931 A1 * 8/2002 Hsien-Te ..... 439/490
2004/0054503 A1 3/2004 Namaky
2006/0036355 A1 2/2006 Schaar et al.

(Continued)

FOREIGN PATENT DOCUMENTS

WO 2007022426 A2 2/2007

OTHER PUBLICATIONS

Sorion Electronic Limited, J1962—OBD Diagnostics Connectors, downloaded from World Wide Web at http://www.sorion-group.com/SEL0051_connector.htm on May 24, 2010, pp. 1-3.

(Continued)

*Primary Examiner* — Chandrika Prasad
(74) *Attorney, Agent, or Firm* — McDonnell Boehnen Hulbert & Berghoff LLP

(57) ABSTRACT

A cable assembly for connecting an electronic device to another electronic device and/or to a signal source. The cable assembly comprises a first connector and a second connector and a plurality of conductors connected between the connectors. The first connector may comprise receptacles for receiving a circuit-interrupter that can open a circuit in the cable assembly when an undesired signal (e.g., a over-voltage signal or an over-current signal) is applied to the cable assembly. The circuit-interrupter may comprise a fuse, such as a non-resettable fuse or a resettable fuse. The first connector may be arranged for connection to an automobile and the second connector may be arranged for connection to an electronic device operable for diagnosing and/or servicing the automobile.

20 Claims, 6 Drawing Sheets

(56) References Cited

U.S. PATENT DOCUMENTS

| | | | |
|---|---|---|---|
| 2006/0149434 | A1 | 7/2006 | Bertosa et al. |
| 2007/0043488 | A1 | 2/2007 | Avery et al. |
| 2007/0073459 | A1 | 3/2007 | Webster et al. |
| 2009/0299539 | A1 | 12/2009 | Chinnadurai et al. |
| 2010/0042288 | A1 | 2/2010 | Lipscomb et al. |
| 2012/0046825 | A1 | 2/2012 | Ruther et al. |

OTHER PUBLICATIONS

Memopad, The OBD2 Cable for Allpro adapter, downloaded from the World Wide Web at http://datawave.oommm.com/entry/USB-OBD2-AllPro-adapter, pp. 1-16, Oct. 8, 2008.

Tyco Electronics, Fundamentals of PolySwitch Overcurrent and Overtemperature Devices, pp. 1-13, Sep. 2, 2009.

International Organization for Standardization, ISO TC 22/SC 3, ISO 15031-1:2001(E), Road vehicles—Communication between vehicle and external test equipment for emissions-related diagnostics—Part 1: General information, 36 pages, Aug. 5, 2001.

International Organization for Standardization, ISO TC 22/SC 3 N, ISO/CD 22900-2, Road vehicles, Modular VCI (Vehicle Communication Interface)—Part 2: D-PDU API (Diagnostic Protocol Data Unit Application Programmer Interface), 144 pages, Mar. 31, 2005.

International Organization for Standardization, ISO TC 22/SC 3 N, ISO/CD 22900-1, Road vehicles—Modular Vehicle Communication Interface (MVCI)—Part 1: Hardware design requirements, 29 pages, Mar. 31, 2005.

International Organization for Standardization, ISO TC 22/SC 3 N, ISO/CD 22900-1, Road vehicles—Modular Vehicle Communication Interface (MVCI)—Part 3: D-Server API (Diagnostic Server Application Programmer Interface), 159 pages, Mar. 31, 2005.

International Organization for Standardization, ISO 15031-3:2400(E), Road vehicles—Communication between vehicle and external equipment for emissions-related diagnostics—Part 3: Diagnostic connector and related electrical circuits, specification and use—Annex B pp. 17-18, Jul. 2004.

* cited by examiner

CABLE ASSEMBLY WITH CIRCUIT-INTERRUPTER-LEAD RECEPTACLES

RELATED APPLICATIONS

This application claims priority to U.S. provisional patent application No. 61/374,805 filed on Aug. 18, 2010. U.S. provisional patent application No. 61/374,805 is incorporated herein by reference.

BACKGROUND

Many electronic devices connect to electrical signal sources (e.g., an electrical power source) and/or other electronic devices via one or more conductors. Each conductor may comprise an insulated conductor comprising a conductive wire and an insulator that surrounds all portions of the conductive wire except the ends of the conductive wire.

The electronic devices identified above may comprise components that can be damaged if an undesired electrical signal is provided to the electronic device. Those components may comprise microprocessors, field-programmable gate arrays, or some other component. As an example, the undesired electrical signal may comprise an over-voltage signal (e.g., an electrical signal having a voltage value greater than a maximum voltage threshold) and/or an over-current signal (e.g., an electrical signal having a current value greater than a maximum current threshold). Other examples of the undesired electrical signal are also possible.

OVERVIEW

Example embodiments arranged in the form of cable assemblies that can protect electronic devices from undesired signals are described. The example cable assemblies are connectable to electronic devices and/or signal sources. An example cable assembly may protect an electronic device and/or a signal source by preventing an undesired signal applied to the cable assembly from being applied to the electronic device and/or the signal source. The electronic device and/or the signal source may be located on and/or within a vehicle, such as an automobile, a truck (e.g., a light-duty, medium-duty, or heavy-duty truck), an airplane, or a motorcycle. In that regard, the example cable assembly may protect the vehicle by preventing the undesired signal applied to the cable assembly from being applied to the electronic device and/or the signal source located on and/or within a vehicle.

In one respect, an example embodiment may take the form of a cable assembly comprising (i) a first connector, (ii) a first set of connector pins attached to the first connector, (iii) a second connector, (iv) a second set of connector pins attached to the second connector, (v) a plurality of conductors comprising at least a first conductor and a second conductor, (vi) a first circuit-interrupter-lead receptacle, and (vii) a second circuit-interrupter-lead receptacle. The first conductor is connected to a connector pin of the first set of connector pins and to the first circuit-interrupter-lead receptacle. The second conductor is connected to a connector pin of the second set of connector pins and to the second circuit-interrupter-lead receptacle.

In another respect, an example embodiment may take the form of a cable assembly comprising (i) a first connector, (ii) a first set of connector pins attached to the first connector, (iii) a second connector, (iv) a second set of connector pins attached to the second connector, (v) a plurality of conductors comprising at least a first conductor and a second conductor, (vi) a first fuse-lead receptacle, (vii) a second fuse-lead receptacle, and (viii) an illuminator. The first conductor is connected to a connector pin of the first set of connector pins and to the first fuse-lead receptacle. The second conductor is connected to a connector pin of the second set of connector pins and to the second fuse-lead receptacle. The illuminator is operable to illuminate when a voltage is applied to the first conductor.

These as well as other aspects and advantages will become apparent to those of ordinary skill in the art by reading the following detailed description, with reference where appropriate to the accompanying drawings. Further, it should be understood that the embodiments described in this overview and elsewhere are intended to be examples only and do not necessarily limit the scope of the invention.

BRIEF DESCRIPTION OF THE DRAWINGS

Example embodiments are described herein with reference to the drawings, in which.

DETAILED DESCRIPTION

I. Introduction

Figure 1:
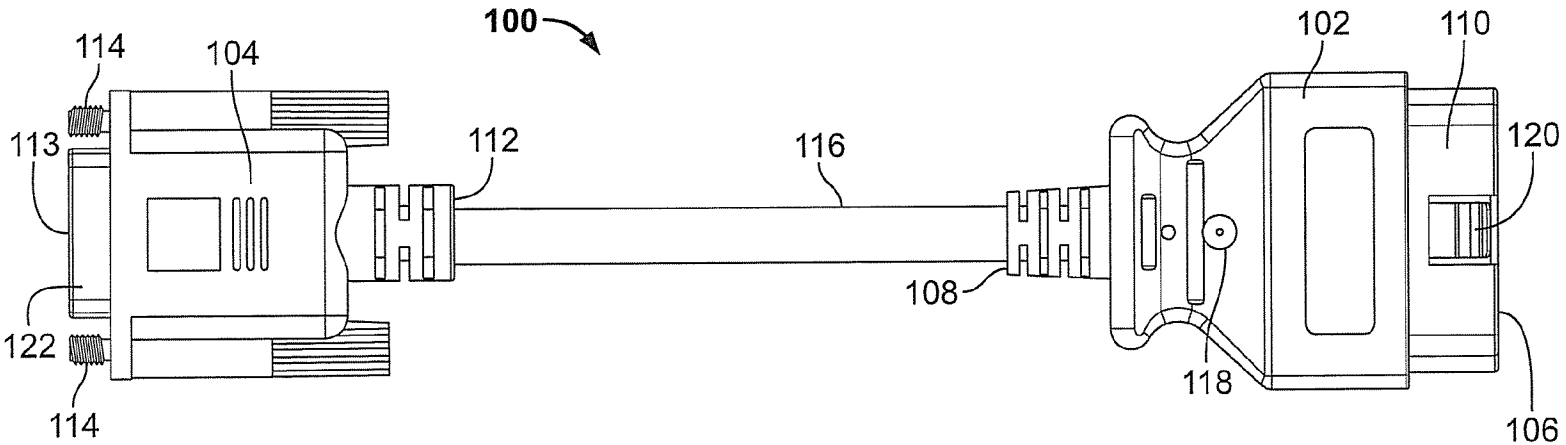
FIG. 1 illustrates an example cable assembly.

Example cable assemblies are described in this description. The example cable assemblies may be used to connect a first electronic device to a second electronic device, an adapter cable, and/or a signal source. The first electronic device may comprise components that can be damaged by an undesired electronic signal. The second electronic device, the adapter cable, and/or the signal source may provide an undesired signal to the cable assembly during a fault condition of the second electronic device, the adapter cable, and/or the signal source. The signal source may be located on and/or within a vehicle, such an automobile, a truck, an airplane, or a motorcycle. Other examples of the vehicle are also possible.

Alternatively, the second electronic device, the adapter cable, and/or the signal source may provide an undesired signal to the cable assembly when the second electronic device, the adapter cable, and/or signal source is not compatible for connecting to the first electronic device. For instance, the second electronic device and/or the signal source might not be compatible if, under its expected operating conditions, it provides a voltage and/or current signal that is greater than what the first electronic device is designed to handle. This might occur when the first electronic device is designed to interface to a 12 volt electrical system of an automobile and the second electronic device comprises an automobile with a 42 volt electrical system.

The example cable assemblies are arranged to receive a circuit-interrupter. As an example, the circuit-interrupter may comprise a fuse, a circuit breaker, or some other type of circuit-interrupter. For purposes of this description, a fuse may comprise a resettable fuse or a non-resettable fuse. After receipt of the circuit-interrupter, each example cable assembly is operable to retain the circuit-interrupter at and/or within the cable assembly until such time that a user or some other means removes the circuit-interrupter from the cable assembly.

A resettable fuse can transition to a non-conductive state when an undesired electrical signal is applied to the resettable fuse. A resettable fuse can transition to a conductive state after the undesired electrical signal is no longer being applied to the resettable fuse. As an example, the resettable fuse may comprise a Positive Temperature Coefficient (PTC) device or some other type of resettable fuse.

A non-resettable fuse may comprise a metal element that melts when an undesired electrical signal is provided to the non-resettable fuse. Prior to the metal element melting, the non-resettable fuse allows an electric current to pass through the non-resettable fuse. After the metal element melts, the non-resettable fuse prevents an electrical current from passing through the non-resettable fuse. Preferably, a non-resettable fuse whose metal element has melted is replaced can be replaced with another non-resettable fuse.

The example cable assemblies may be utilized with any appropriate voltage or current source, such as a battery, an alternator, a fuel cell, and the like, providing any appropriate current and/or voltage, such as about 12 volts, about 42 volts, and the like. The example cable assemblies may be used with any desired electronic device(s). Those electronic device(s) may interface to other systems, such as an automobile, a truck, a boat or ship, a motorcycle, a generator, an airplane and the like.

II. Example Embodiment 1

FIG. 1 illustrates an example embodiment of a cable assembly 100. As illustrated in FIG. 1, cable assembly 100 includes connector 102, connector 104, and a jacket 116 extending between connector 102 and connector 104. Respective portions of jacket 116 may extend within connector 102 or connector 104.

Connector 102 includes connector ends 106 and 108, a connection pin shield 110, an illuminator 118, and a connector clip 120. Illuminator 118 may comprise a light emitting diode (LED), an incandescent light bulb, or some other type of illuminator. Connector clip 120 may be used to secure connector 102 to a mating connector that comprises another connector clip, a connector clip slot, or some other interface to connector clip 120.

Connector 102 may comprise any of a variety of connectors. As an example, connector 102 may comprise a Society of Automotive Engineers (SAE) standard J-1962 connector. For purposes of this description, an SAE standard J-1962 connector comprises a connector having a connector pin arrangement in accordance with SAE standard J-1962. An SAE standard J-1962 connector may include male connector pins or female connector pins. As another example, connector 102 may comprise a connector having a connector pin arrangement in accordance with an ISO standard developed by the International Organization for Standardization of Geneva, Switzerland. In this regard, the ISO standard may comprise the ISO 15031 Standard entitled Road vehicles—Communication between vehicle and external equipment for emissions-related diagnostics—Part 3: Diagnostic connector and related electrical circuits, specification and use.

Connector 104 includes connector ends 112 and 113, screws 114, and a connector pin shield 122. Screws 114 may be used to secure connector 104 to a mating connector that comprises attachment holes to receive screws 114.

Connector 104 may comprise any of a variety of connectors. As an example, connector 104 may comprise a high-density 26-pin connector (HD26 connector). The HD26 connector may comprise male connector pins, female connector pins, or some combination of male connector pins and female connector pins.

Jacket 116 provides a passage for one or more conductors. One or more of those conductors may extend from connector 102 to connector 104. Jacket 116 may comprise a metal shield to prevent and/or reduce electro-magnetic interference within the conductors within jacket 116. The metal shield may connect to a conductor that connects to an electrical ground when one of connectors 102 and 104 is connected to a mating connector or when connectors 102 and 104 are connected to respective mating connectors. A length of jacket 116 may be any of a variety of lengths, such as 25 centimeters (cm), 30 cm, 40 cm, or some other length.

Figure 2:
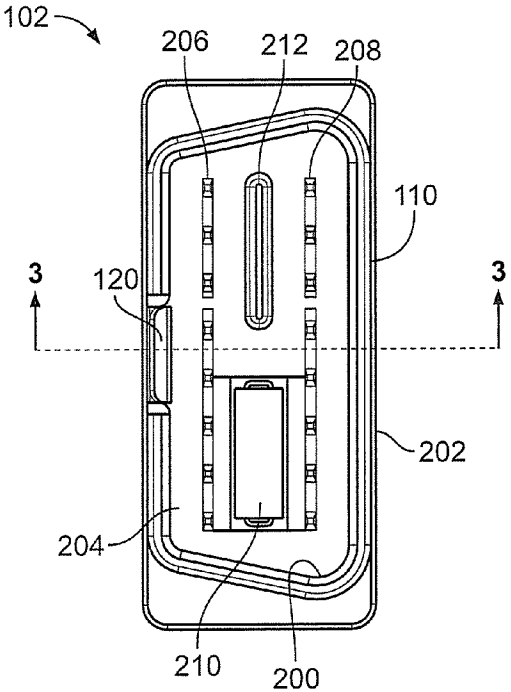
FIG. 2 illustrates an example connector of the cable assembly illustrated in FIG. 1.

Next, FIG. 2 illustrates details of cable assembly 100 when looking towards connector end 106 of connector 102. As illustrated in FIG. 2, connector pin shield 110 includes inner surface 200 and outer surface 202. Furthermore, FIG. 2 illustrates that connector 102 includes a connection area 204 defined, in part, by inner surface 200, rows of connector pins 206 and 208, a circuit-interrupter 210, and a connector pin divider 212. The connector pins of rows of connector pins 206 and 208 are attached to connector 102 and may be connected to conductors within jacket 116.

In accordance with the example embodiments of this application, the connector pins may be arranged in any of a variety of configurations. Each connector pin may comprise a first end, a second end, and a longitudinal portion that extends between the first and second ends of a connector pin. The first end may be arranged as a male connector that can be inserted into a female connector at and/or within a mating connector. Alternatively, the first end of a connector pin may be arranged as a female connector that can receive a male connector pin at and/or within a mating connector. The second end of a connector pin may be arranged to receive a conductor, such as a conductor within jacket 116. The second end of a connector pin can be crimped around a conductor so as to retain the conductor to the connector pin.

In accordance with an example embodiment in which connector 102 comprises an SAE standard J-1962 connector, row of connector pins 206 includes eight connector pins and row of connector pins 208 includes eight connector pins. In accordance with this example, connector 102 is arranged for connection to a mating connector arranged as an SAE standard J-1962 connector. Connector pin divider 212 (located between rows of connector pins 206 and 208) may prevent connecting connector 102 to some SAE standard J-1962 connectors, such as an SAE standard J-1962 connector that is connected to a voltage source that provides power signals above a threshold voltage level.

Figure 3:
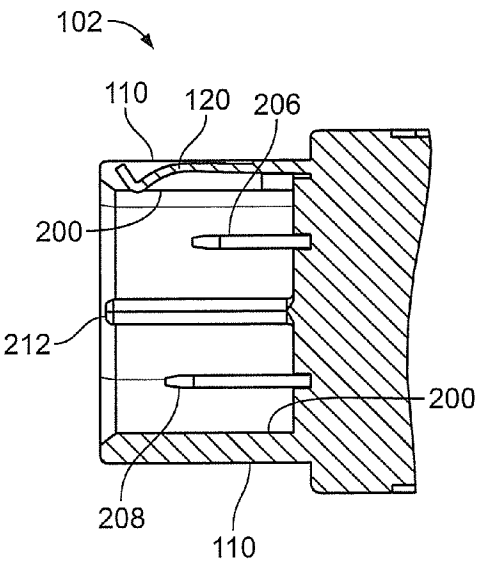
FIG. 3 illustrates a partial sectional view of the connector illustrated in FIG. 2.

Next, FIG. 3 illustrates a partial sectional view of connector 102. In particular, FIG. 3 illustrates a connector pin of row of connector pins 206, a connector pin of row of connector pins 208, connector pin divider 212, connector pin shield 110, and inner surface 200 of connector pin shield 110. The connector pins of rows of connector pins 206 and 208 may be a common length or one or more of the connector pins may have a length that differs from other connector pins of rows of connector pins 206 and 208. As an example, a given connector pin, designated for connecting to a mating connector pin connected to an electrical ground, may have a length longer than other connector pins so that the given connector pin makes contact with the mating connector pin prior to the other connector pins making contact with their respective mating connector pins.

Figure 4:
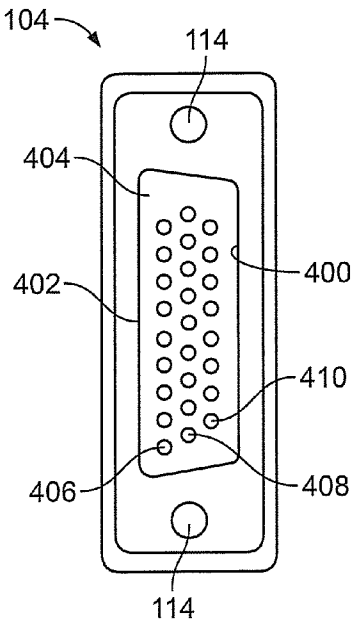
FIG. 4 illustrates another example connector of the cable assembly illustrated in FIG. 1.

Next, FIG. 4 illustrates details of connector 104 when looking towards connector end 113. As illustrated in FIG. 4, connector pin shield 122 includes inner surface 400 and outer surface 402. Furthermore, FIG. 4 illustrates connector 104 includes a connection area 404 defined, in part, by inner surface 400 and rows of connector pins 406, 408, and 410. The connector pins of rows of connector pins 406, 408, and 410 are attached to connector 104 and may be connected to conductors within jacket 116.

In accordance with an example embodiment in which connector 102 comprises an HD26 connector, row of connector pins 406 includes nine connector pins, row of connector pins 408 includes nine connector pins, and row of connector pins 410 includes eight connector pins. In accordance with this example, connector 104 is arranged for connection to a mating connector arranged as an HD26 connector.

Figure 5:
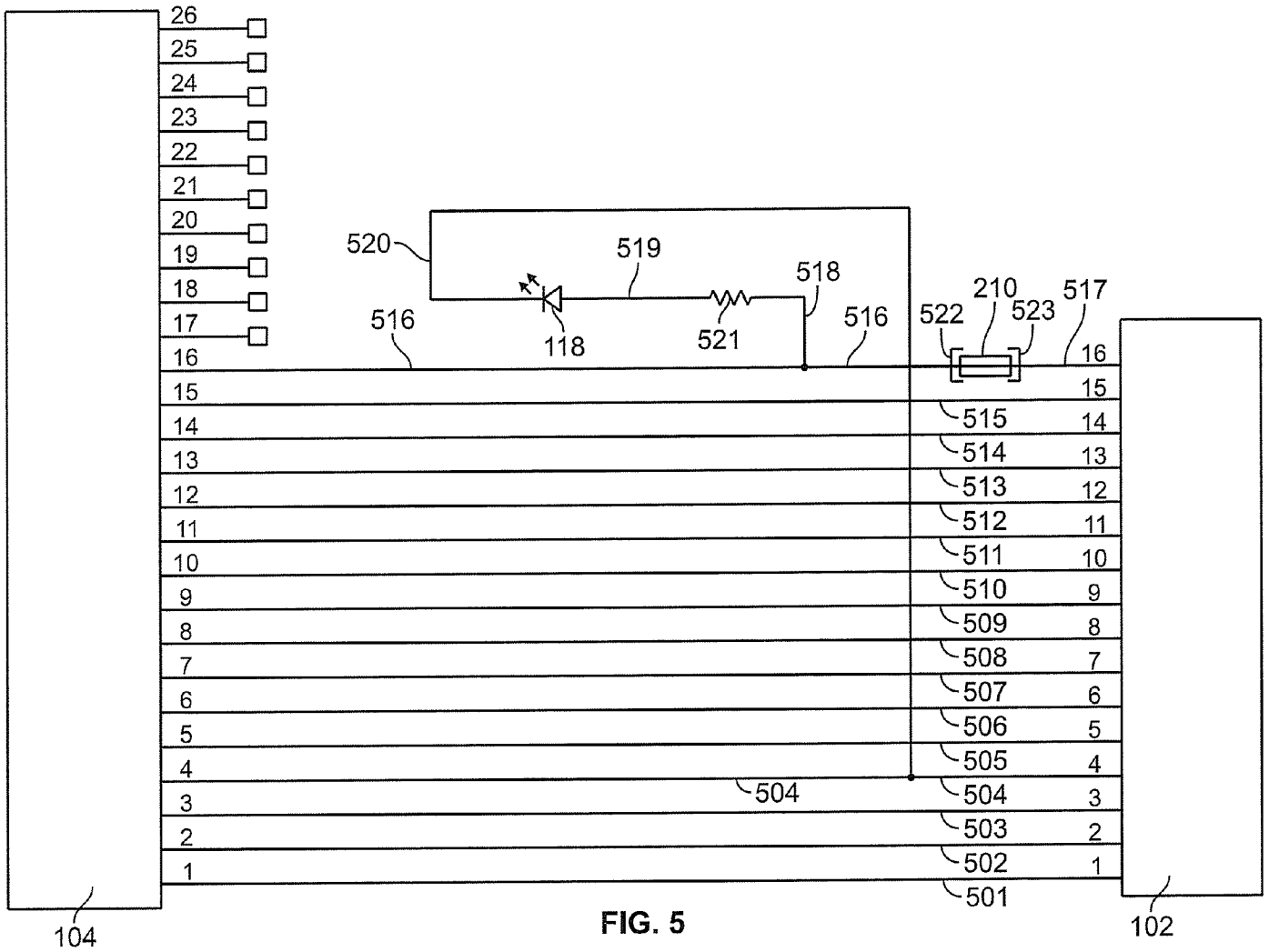
FIG. 5 is an example schematic diagram of conductors within the cable assembly illustrated in FIG. 1.

Next, FIG. 5 illustrates an example schematic diagram in accordance with an example embodiment. In particular, FIG. 5 illustrates connectors 102 and 104, illuminator 118, circuit-interrupter 210, conductors 501 through 520, and a resistor 521. The numbers 1 through 16 next to connector 102 refer to connector pin numbers at and/or within connector 102. The numbers 1 through 26 next to connector 104 refer to connector pin numbers at and/or within connector 104. People having ordinary skill in the art will understand that the connector pins of connector 102 and/or connector 104 may be referenced using characters other than numbers, and that connector 102 may include a number of connector pins other than 16. People having ordinary skill in the art will also understand that connector 104 may include a number of connector pins other than 26.

Conductors 501 through 515 extend from connector 102 to connector 104. A first end of each conductor of conductors 501 through 515 connects to a respective connector pin located at and/or within connector 102. A second end of each conductor of conductors 501 through 515 connects to a respective connector pin located at and/or within connector 104. A first end of conductor 516 connects to a connector pin at and/or within connector 104 and a second end of conductor 516 connects to a circuit-interrupter-lead receptacle 522. A first end of conductor 517 connects to a circuit-interrupter-lead receptacle 523 and a second end of conductor 517 connects to connector 102.

Circuit-interrupter-lead receptacles 522 and 523 are electrically-conductive and can be located within connector 102. Circuit-interrupter 210 can include electrically-conductive leads. Each of those electrically-conductive leads can be inserted into one of circuit-interrupter-lead receptacles 522 and 523. In an example embodiment in which circuit-interrupter 210 comprises a fuse, each of circuit-interrupter-lead receptacles 522 and 523 is arranged as a fuse-lead receptacle.

A first end of conductor 518 connects to conductor 516 and a second end of conductor 518 connects to a first end of resistor 521. A first end of conductor 519 connects to a second end of resistor 521 and to a first end of illuminator 118. A first end of conductor 520 connects to a second end of illuminator 518 and to conductor 504. Other examples of conductors and connections to the conductors of the example cable assemblies are also possible.

III. Example Embodiment 2

Figure 6:
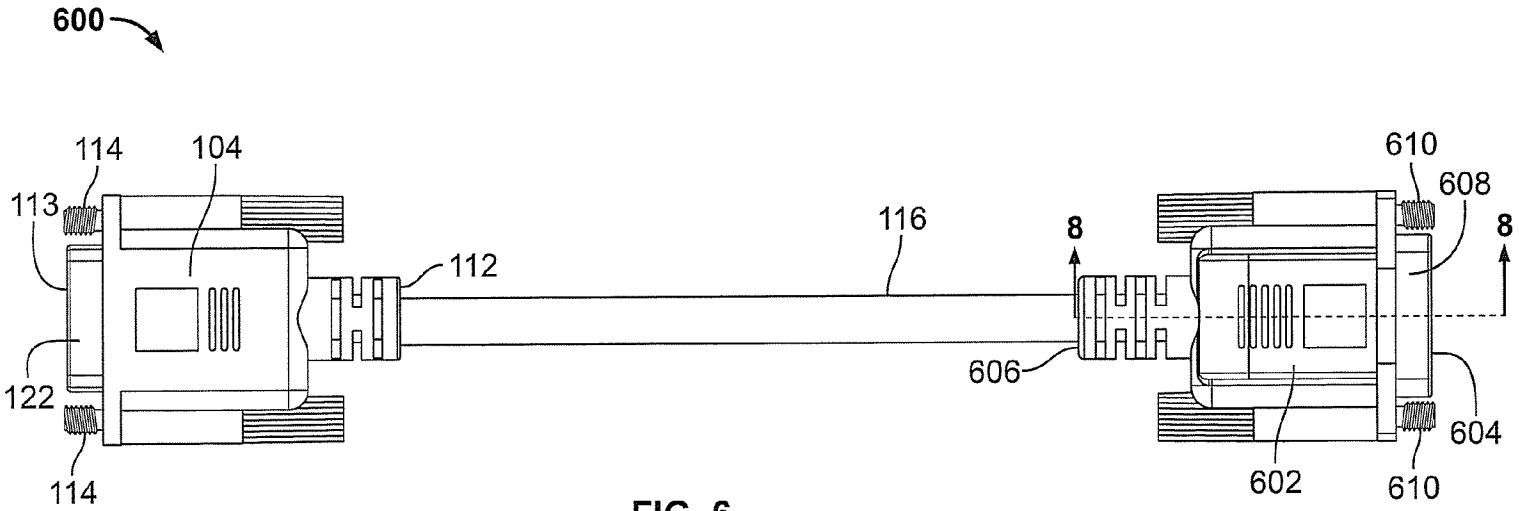
FIG. 6 illustrates another example cable assembly.

FIG. 6 illustrates an example embodiment of a cable assembly 600. As illustrated in FIG. 6, cable assembly 600 includes connector 104, connector 602, and jacket 116 extending between connectors 104 and 602. Respective portions of jacket 116 may extend within connector 104 or connector 602. Connector 104 and jacket 116 were described above with respect to cable assembly 100.

Connector 602 includes connector ends 604 and 606, a connection pin shield 608, and screws 610. Screws 610 may be used to secure connector 602 to a mating connector that comprises attachment holes to receive screws 610.

Connector 602 may comprise any of a variety of connectors. As an example, connector 602 may comprise a D-sub-miniature connector (also known as a D-sub connector). A D-sub connector may comprise male connector pins, female connector pins, or some combination of male connector pins and female connector pins. A D-sub connector may comprise various numbers of connector pins, such as 9, 15, 25, 37, or 50 connector pins. Other examples of the number of connector pins of a D-sub connector are also possible. A D-sub connector with X number of connector pins is commonly referred to as a DBX connector, where X equals the number of connector pins. For example, a D-sub connector with 15 connector pins is commonly referred to as a DB15 connector.

Figure 7:
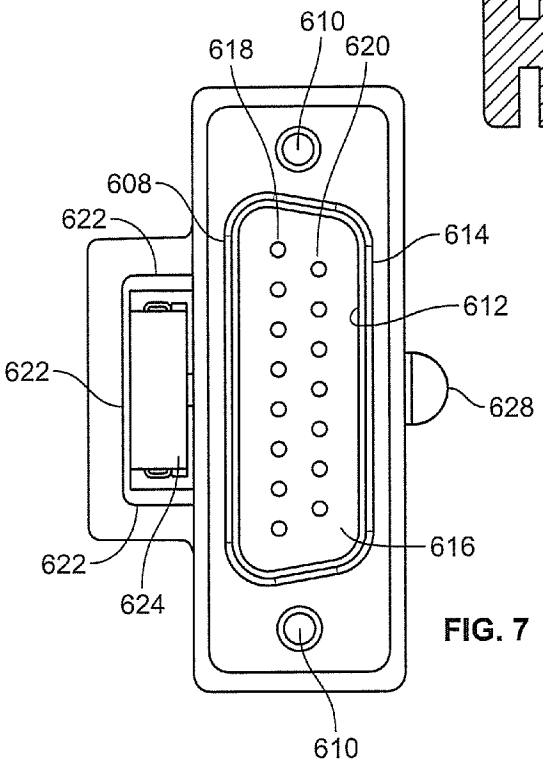
FIG. 7 illustrates an example connector of the cable assembly illustrated in FIG. 6.

Next, FIG. 7 illustrates details of cable assembly 600 when looking towards connector end 604. As illustrated in FIG. 7, connector 602 further includes inner surface 612, outer surface 614, connection area 616, rows of connector pins 618 and 620, a circuit-interrupter cover 622 and a circuit-interrupter 624. Connection area 616 is defined, in part, by inner surface 612 and rows of connector pins 618 and 620. Connector pins of rows of connector pins 618 and 620 are attached to connector 602 and may be connected to conductors within jacket 116.

In accordance with an example embodiment, connector 602 may comprise a DB15 male connector. In accordance that example embodiment, row of connector pins 618 includes eight male connector pins, row of connector pins 620 includes seven male connector pins, and connector 602 is arranged for connection to a DB15 female connector.

Figure 8:
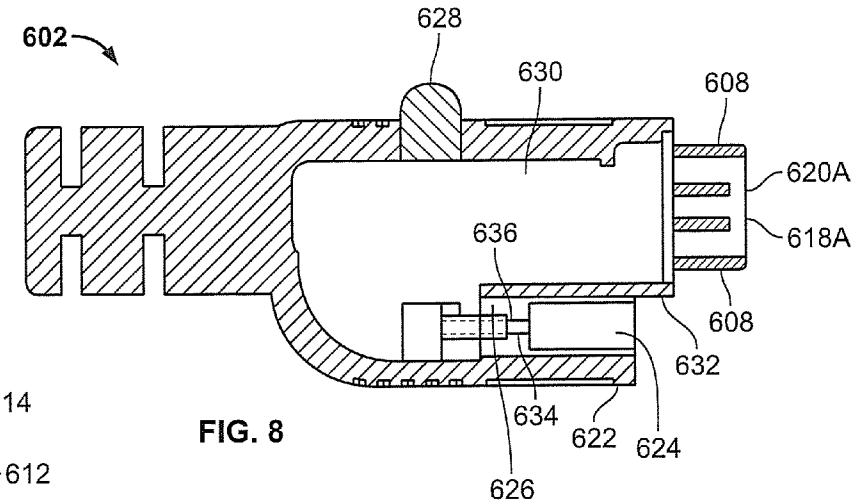
FIG. 8 illustrates a partial sectional view of a connector illustrated in FIG. 6.

Next, FIG. 8 illustrates a partial sectional view of connector 602. In particular, FIG. 8 illustrates a connector pin 618A of row of connector pins 618 (shown in FIG. 7), a connector pin 620A of row of connector pins 620 (shown in FIG. 7), circuit-interrupter cover 622, circuit-interrupter 624, a circuit-interrupter housing 626, an illuminator 628, and a connector pin housing 630. Circuit-interrupter housing 626 may be defined, in part, by circuit-interrupter cover 622, and a circuit-interrupter cover 632 that is located between circuit-interrupter 624 and connector pin housing 630. Illuminator 628 may comprise a light emitting diode (LED), an incandescent light bulb, or some other type of illuminator. Portions of connector pins of rows of connector pins 618 and 620 may extend into connector pin housing 630.

Circuit-interrupter 624 may include circuit-interrupter-leads 634 and 636. Circuit-interrupter-lead 634 is insertable into circuit-interrupter-lead receptacle 929 (illustrated in FIG. 9). Circuit-interrupter-lead 636 is insertable into circuit-interrupter-lead receptacle 930 (illustrated in FIG. 9).

Figure 9:
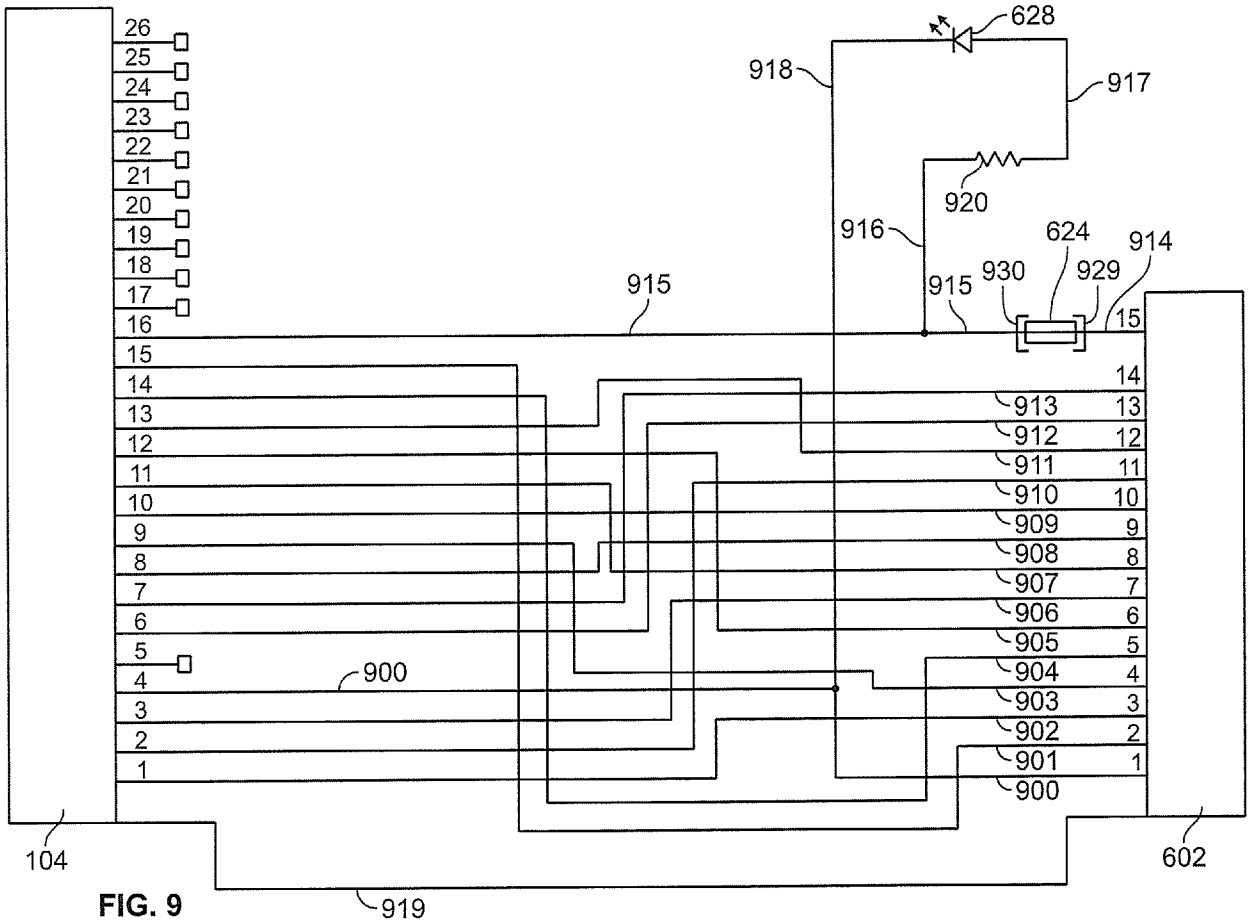
FIG. 9 is an example schematic diagram of conductors within the cable assembly illustrated in FIG. 6.

Next, FIG. 9 illustrates an example schematic diagram in accordance with an example embodiment. In particular, FIG. 9 illustrates connectors 104 and 602, circuit-interrupter 624, illuminator 628, conductors 900 through 919, a resistor 920, and circuit-interrupter-lead receptacles 929 and 930. The numbers 1 through 15 next to connector 602 refer to connector pin numbers at and/or within connector 602. The numbers 1 through 26 next to connector 104 refer to connector pin numbers at and/or within connector 104. People having ordinary skill in the art will understand that the connector pins of connector 602 and/or connector 104 may be referenced using characters other than numbers. Furthermore, people having ordinary skill in the art will understand that connector 602 may include a number of connector pins other than 15, and connector 104 may include a number of connector pins other than 26.

Conductors 900 through 913 and conductor 919 extend from connector 104 to connector 602. A first end of each conductor of conductors 900 through 913 connects to a respective connector pin located at and/or within connector 104. A second end of each conductor of conductors 900 through 913 connects to a respective connector pin located at and/or within connector 602. Conductor 919 may comprise a metal shield within jacket 116.

A first end of conductor 914 connects to a connector pin at and/or within connector 602 and a second end of conductor 914 connects to circuit-interrupter-lead receptacle 929. A first end of conductor 915 connects to circuit-interrupter-lead receptacle 930 and a second end of conductor 915 connects to connector 104. Circuit-interrupter 624 connects to circuit-interrupter-lead receptacles 929 and 930.

A first end of conductor 916 connects to conductor 915 and a second end of conductor 916 connects to a first end of resistor 920. A first end of conductor 917 connects to a second end of resistor 920 and to a first end of illuminator 628. A first end of conductor 918 connects to a second end of illuminator 628 and to conductor 900. Other examples of conductors and connections to the conductors within cable assembly 600 are also possible.

IV. Example Operation a. Cable Assembly 100

Cable assembly 100 is operable to connect two devices together. In accordance with the example embodiment in which connector 102 comprises an SAE standard J-1962 connector, connector 102 is connectable to a mating connector within an automobile and connector 104 is connectable to an electronic device for use in diagnosing and/or servicing the automobile. As an example, the electronic device connectable to connector 104 may be arranged as a vehicle scanner such as vehicle scanner 106 described in U.S. patent application Ser. No. 12/859,051, which is hereby incorporated by reference, and which was filed on Aug. 18, 2010 and is entitled "System and Method for Universal Scanner Module to Buffer and Bulk Send Vehicle Data Responsive to Network Conditions."

Accordingly, an example embodiment may include a vehicle scanner and cable assembly 100. In addition to connecting to the vehicle scanner, cable assembly 100 may connect to the automobile. The circuit interrupter 210 may protect both the vehicle scanner and the automobile under various circumstances, such as the circumstances when circuit 516 is short-circuited to the chassis (e.g., an electrical ground) of the automobile (e.g., when a door of the automobile is closed while cable assembly 100 is extending through the door opening.

Additionally, in accordance with this example embodiment, when connector 102 is connected to the mating connector, pin 16 of connector 102 is connected to a battery signal within the automobile and pin 4 of connector 102 is connected to an electrical ground within the vehicle. When such connections are made, circuit illuminator 118 illuminates. Such illumination may be used to indicate that battery power is being provided to the electronic device connected to connector 104. If circuit-interrupter 210 is opened due to an undesired signal being applied to circuit-interrupter 210, circuit illuminator 118 will not illuminate.

b. Cable Assembly 600

Cable assembly 600 is operable to connect two devices together. As an example, connector 104 of cable assembly 600 is connectable to an electronic device for use in diagnosing and/or servicing an automobile in the same way that connector 104 of cable assembly 100 is connectable to the electronic device, and connector 602 is connectable to an adapter cable that is connectable to an automobile. In accordance with that example, the adapter cable may comprise (i) an SAE standard J-1962 connector that is connectable to the automobile, and (ii) a DB15 female connector that is connectable to connector 602. Other examples of the devices connectable to connectors 104 and 602 of cable assembly 600 are also possible.

Accordingly, an example embodiment may include a vehicle scanner and cable assembly 600. In addition to connecting to the vehicle scanner, cable assembly 600 may connect to the automobile. The circuit interrupter 624 may protect both the vehicle scanner and the automobile under various circumstances, such as the circumstances when circuit 915 is short-circuited to the chassis (e.g., an electrical ground) of the automobile (e.g., when a door of the automobile is closed while cable assembly 600 is extending through the door opening.

Additionally, in accordance with an example embodiment, when connector 602 is connected to a mating connector, pin 15 of connector 602 may be connected to a voltage signal and pin 1 of connector 602 may be connected to an electrical ground. When such connections are made, circuit illuminator 628 illuminates. Such illumination may be used to indicate that the voltage signal is being provided (or is available for providing) to the electronic device connected to connector 104. If circuit-interrupter 624 is opened due to an undesired signal being applied to circuit-interrupter 624, circuit illuminator 628 will not illuminate.

V. Alternative Electrical Circuitry

Various modifications may be made to the electrical circuits shown in the schematic diagram illustrated in FIG. 5. For instance, resistor 521 may be located within conductor 520 instead of between conductors 518 and 519 such that conductor 519 may be omitted and the second end of conductor 518 may connect to the first end of illuminator 118 instead of to the first end of the resistor.

Additionally, for an embodiment in which conductor 516 is supplied with electrical power (e.g., connected to a battery) via connector 104 instead of via connector 102, conductor 518 may be connected to conductor 517 instead of to conductor 516. In accordance with that alternative arrangement, resistor 521 may be located between conductors 518 and 519 or, as described above, resistor 521 may be located within conductor 520 instead of between conductors 518 and 519 such that conductor 519 may be omitted and the second end of conductor 518 may connect to the first end of illuminator 118 instead of to the first end of the resistor.

Various modifications may be made to the electrical circuits shown in the schematic diagram illustrated in FIG. 9. For instance, resistor 920 may be located within conductor 918 instead of between conductors 916 and 917 such that conductor 917 may be omitted and the second end of conductor 916 may connect to the first end of illuminator 628 instead of to the first end of the resistor.

Additionally, for an embodiment in which conductor 915 is supplied with electrical power (e.g., connected to a battery) via connector 104 instead of via connector 602, conductor 916 may be connected to conductor 914 instead of to conductor 915. In accordance with that alternative arrangement, resistor 920 may be located between conductors 916 and 917 or, as described above, resistor 920 may be located within conductor 918 instead of between conductors 916 and 917 such that conductor 917 may be omitted and the second end of conductor 916 may connect to the first end of illuminator 628 instead of to the first end of the resistor.

VI. Conclusion

Example embodiments have been described above. Those skilled in the art will understand that changes and modifications may be made to the described embodiments without departing from the true scope and spirit of the present invention, which is defined by the claims.

We claim:

1. A cable assembly comprising:

a first connector;

a first set of connector pins attached to the first connector;

a second connector;

a second set of connector pins attached to the second connector;

a plurality of conductors comprising at least a first conductor and a second conductor;

a first circuit-interrupter-lead receptacle; and a second circuit-interrupter-lead receptacle, wherein the first conductor is connected to a connector pin of the first set of connector pins and to the first circuit-interrupter-lead receptacle, wherein the second conductor is connected to a connector pin of the second set of connector pins and to the second circuit-interrupter-lead receptacle, and wherein insertion of a circuit-interrupter into the first circuit-interrupter-lead receptacle and into the second circuit-interrupter-lead receptacle connects the first conductor and the second conductor as part of a series circuit.

2. The cable assembly of claim 1, further comprising:

a circuit-interrupter having a first circuit-interrupter-lead and a second circuit-interrupter-lead, wherein the first circuit-interrupter-lead is insertable into the first circuit-interrupter-lead receptacle, and wherein the second circuit-interrupter-lead is insertable into the second circuit-interrupter-lead receptacle.

3. The cable assembly of claim 2, further comprising:

a light emitting diode (LED); and a resistor, wherein the plurality of conductors comprises a third conductor connected to a second connector pin of the first set of connector pins and to a second connector pin of the second set of connectors pins, and wherein the LED and resistor are connected in series between the second conductor and the third conductor.

4. The cable assembly of claim 3, wherein the LED comprises an anode end and a cathode end, wherein the resistor comprises a first resistor end and a second resistor end, wherein the cathode end is connected to the third conductor, wherein the anode end is connected to the first resistor end, and wherein the second resistor end is connected to the second conductor.

5. The cable assembly of claim 3, wherein the LED comprises an anode end and a cathode end, wherein the resistor comprises a first resistor end and a second resistor end, wherein the anode end is connected to the second conductor, wherein the cathode end is connected to the first resistor end, and wherein the second resistor end is connected to the third conductor.

6. The cable assembly of claim 3, wherein the first conductor is arranged for connection to a vehicle battery supply line via the first connector, wherein the third conductor is arranged for connection to an electrical ground conductor via the first connector, wherein, while the first conductor is connected to the vehicle battery supply line, the third conductor is connected to the electrical ground conductor, and the circuit interrupter comprises a closed circuit, the LED is illuminated, and wherein, while the first conductor is connected to the vehicle battery supply line, the third conductor is connected to the electrical ground conductor, and the circuit interrupter comprises an open circuit, the LED is not illuminated.

7. The cable assembly of claim 2, wherein the first connector comprises a connection area and a connector pin divider, wherein the first set of connector pins comprises first connectors pins arranged as a first row of connector pins and second connector pins arranged as a second row of connector pins, wherein each connector pin of the first connector pins and each connector pin of the second connector pins comprises a respective longitudinal portion that extends into the connection area, and wherein the connector pin divider and the circuit-interrupter are located in the connection area and between the first row of connector pins and the second row of connector pins.

8. The cable assembly of claim 1, wherein the first connector is arranged for connection to a vehicle-electronics connector, and wherein the second connector is arranged for connection to a vehicle scan tool.

9. The cable assembly of claim 8, wherein the first connector and the vehicle-electronics connector each comprise a respective Society of Automotive Engineers (SAE) standard J-1962 connector.

10. The cable assembly of claim 9, wherein the second connector comprises an HD-26 connector.

11. The cable assembly of claim 8, wherein the first connector and vehicle electronics connector each comprise a respective connector arranged in accordance with ISO standard 15031.

12. The cable assembly of claim 2, further comprising:

a connection area, wherein each connector pin of the first set of connector pins comprises a respective longitudinal portion that extends into the connection area, and a circuit-interrupter housing that comprises an opening through which the circuit-interrupter can be inserted into the circuit-interrupter housing and removed from the circuit-interrupter housing, and wherein the circuit-interrupter housing and the connection area are separated by a circuit-interrupter cover.

13. The cable assembly of claim 2, further comprising:

a jacket that extends between the first connector and the second connector, wherein the jacket provides a passage for the plurality of conductors between the first connector and the second connector.

14. The cable assembly of claim 2, wherein the circuit-interrupter comprises a non-resettable fuse.

15. The cable assembly of claim 2, wherein the circuit-interrupter comprises a resettable fuse.

16. A cable assembly comprising:

a first connector;

a first set of connector pins attached to the first connector;

a second connector;

a second set of connector pins attached to the second connector;

a plurality of conductors comprising at least a first conductor and a second conductor;

a first fuse-lead receptacle;

a second fuse-lead receptacle; and an illuminator, wherein the first conductor is connected to a connector pin of the first set of connector pins and to the first fuse-lead receptacle, wherein the second conductor is connected to a connector pin of the second set of connector pins and to the second fuse-lead receptacle, wherein insertion of a fuse into the first fuse-lead receptacle and into the second fuse-lead receptacle connects the first conductor and the second conductor as part of a series circuit, and wherein the illuminator is operable to illuminate when a voltage is applied to the first conductor.

17. The cable assembly of claim 16, further comprising:

a fuse having a first fuse-lead and a second fuse-lead, wherein the first fuse-lead is insertable into the first fuse-lead receptacle, and wherein the second fuse-lead is insertable into the second fuse-lead receptacle.

18. The cable assembly of claim 17, wherein the fuse comprises a non-resettable fuse.

19. The cable assembly of claim 17, wherein the fuse comprises a resettable fuse.

20. The cable assembly of claim 16, further comprising:

a connection area, wherein each connector pin of the first set of connector pins comprises a respective longitudinal portion that extends into the connection area, and a circuit-interrupter housing that comprises an opening through which the circuit-interrupter can be inserted into the circuit-interrupter housing and removed from the circuit-interrupter housing, and wherein the circuit-interrupter housing and the connection area are separated by a circuit-interrupter cover.

* * * * *